United States Patent [19]

Vorlow

[11] Patent Number: 4,925,573

[45] Date of Patent: May 15, 1990

[54] PROCESS FOR SEPARATING HYDROPROCESSED EFFLUENT STREAMS

[75] Inventor: Sotiris Vorlow, The Hague, Netherlands

[73] Assignee: Shell Internationale Research Maatschappij, B.V., The Hague, Netherlands

[21] Appl. No.: 330,813

[22] Filed: Mar. 30, 1989

[30] Foreign Application Priority Data

Mar. 31, 1988 [GB] United Kingdom ..... 8807807

[51] Int. Cl.[5] ..... C10G 35/04

[52] U.S. Cl. ..... 208/100; 208/95; 208/102; 208/103; 208/104; 208/105

[58] Field of Search ..... 208/104, 103, 102, 100, 208/95

[56] References Cited

U.S. PATENT DOCUMENTS

| | | | |
|---|---|---|---|
| 3,371,029 | 2/1968 | Weiland | 208/104 |
| 3,371,030 | 2/1968 | Penistein | 208/102 |
| 3,402,122 | 9/1968 | Atwater et al. | 208/104 |
| 3,445,378 | 5/1969 | Graff | 208/104 |
| 3,520,800 | 7/1970 | Forber | 208/103 |
| 3,546,099 | 12/1970 | Sutherland | 208/102 |
| 3,586,619 | 6/1971 | Stine | 208/100 |
| 3,598,720 | 8/1971 | Stolfa | 208/89 |
| 3,607,726 | 9/1971 | Hallman | 208/108 |
| 3,617,502 | 11/1971 | Stolfa | 208/89 |
| 3,649,519 | 3/1972 | Watkins | 208/59 |
| 3,666,658 | 5/1972 | Hullman | 208/103 |
| 4,002,432 | 1/1977 | Brice et al. | 208/102 |
| 4,159,935 | 7/1979 | Scott | 208/54 |
| 4,159,937 | 7/1979 | Scott | 208/104 |
| 4,190,520 | 2/1980 | Gewartowski | 208/100 |
| 4,364,820 | 12/1982 | De Graff et al. | 208/102 |
| 4,673,488 | 6/1987 | Turner et al. | 208/103 |

*Primary Examiner*—Helane Myers

[57] ABSTRACT

Process for separating a mixed-phase hydrocarbonaceous effluent originating from the conversion of a hydrocarbonaceous feedstock in the presence of hydrogen at elevated temperature and pressure in a multiple separator system, which effluent contains hydrogen, normally liquid hydrocarbonaceous components and normally gaseous hydrocarbonaceous components by (i) separating in a first separation zone the effluent into a first liquid phase (L1) and a first vapor phase (V1), (ii) cooling the first vapor phase obtained to a temperature in the range between 25° and 85° C. and separating the cooled vapor phase in a second separation zone while substantially maintaining the pressure of the first separation zone into a second liquid phase (L2) and a second, hydrogen-rich vapor phase (V2), (iii) separating the first liquid phase in a third separation zone while substantially maintaining the temperature of the first separation zone and at a pressure below 60 bar into a third liquid phase (L3) and a third vapor phase (V3), and (iv) separating the second light phase in a fourth separation zone while substantially maintaining the temperature of the second separation zone and at a pressure below 60 bar into a fourth liquid phase (L4) which is at least partially recovered as product and a fourth vapor phase (V4), and wherein the first separation zone is operated at a temperature between 200° and 350° C. and in such a way that between 25 and 75% w of the effluent is obtained in the first vapor phase (V1).

20 Claims, No Drawings

PROCESS FOR SEPARATING HYDROPROCESSED EFFLUENT STREAMS

The present invention relates to the separation of hydroprocessed effluent streams.

In the art of petroleum refining normally a number of products are obtained which need to be separated after the envisaged process has been carried out. In the case of refining processes carried out in the presence of hydrogen an additional problem resides in the removal and recovery of hydrogen which is normally recycled to the reaction stage(s) of the process. The reactor effluent of the hydroprocessed feedstock therefore invariably contains hydrogen besides normally gaseous products, normally liquid products and unconverted feedstock.

Much attention has been paid over the years to the separation aspects of reactor effluents. Since reactor effluents are normally obtained at relatively high pressures (depending on the nature of the hydroconversion process applied from as low as 20 to more than 200 bar) and rather high temperatures (depending on the nature of the hydroconversion process ranging from as low as 150° to over 400° C.) it will be evident that a careful control and use of the heat balance of the total unit concerned is of great importance.

Generally speaking the state of the art in effluent separation processes/hydrogen recovery revolves around the so-called four separator system. This system comprises a hot separator (operating at high temperature and pressure), a cold separator (operating at high pressure and lower temperature), a hot flash (operating at high temperature and low pressure) and a cold flash (operating at low temperature and low pressure). A survey of the prior art concerning separator systems is given in U.S. Pat. No. 4,159,937 issued in 1979.

Reference is made therein to U.S. Pat. No. 3,402,122, issued in 1968 wherein the concept of four separators is disclosed in detail for the recovery of an absorption medium from a black oil reaction product effluent. Salient features include recovery of the absorption medium from condensed hot flash vapours by means of a hot flash condensate receiver and also the introduction of cold flash liquid obtained from the cold flasher into the cold separator to increase the concentration of hydrogen to be recycled to the reactor after its separation using the cold separator.

Also, reference is made therein to U.S. Pat. No. 3,371,029 which relates to a similar separation technique using four separators. Hot separator vapours are condensed and introduced into the cold separator, while the hot separator liquid phase passes into the hot flash zone. Hot flash zone vapours are condensed, admixed with the cold separator liquid phase and introduced into the cold flash zone. A portion of the cold flash liquid phase is recycled to the cold separator to increase the amount of hydrogen to be separated using the cold separator. The remainder of the cold flash liquid phase is admixed with the hot flash liquid phase and fractionated for desired product recovery.

It should be noted that the process as described in U.S. Pat. No. 4,159,937 is based on a four separator system wherein the cold separator liquid phase is increased in temperature by means of an additional heat exchanger and introduced into a warm rather than into a cold flash zone (referred to as third separation zone). The use of such a "warm flash" allows recycle of at least part of the liquid phase from the third separation zone to the cold separator (second separation zone) after mixing with the hot separator vapour phase and prior to subjecting the mixed stream to a heat-exchange treatment in order to reduce losses of valuable hydrogen during the recovery stage.

In the process as described in U.S. Pat. No. 3,586,619 use is made of a liquid recycle stream from the cold flash zone to the hot separator vapour phase which is operated at conditions directed at the substantial dissolution of hydrogen in the hot separator liquid phase prior to its use as a feedstock for a thermal cracking process. It will be appreciated that the hot separator has to be operated at a rather high temperature in order to achieve this.

A hot separator, a cold separator and a hot flash zone (provided with a mesh blanket) operated in conjunction with a vacuum column are described in U.S. Pat. No.3,371,030 also referred to in U.S. Pat. No.4,159,937. . A portion of the heavy vacuum gasoil recovered from the vacuum column is reintroduced into the hot flash zone above the mesh blanket to function as a wash oil. Cold separator liquid is admixed with hot flash vapours and recovered as the product of the process.

From the above it will be clear that apart from optimising the temperature and the pressure requirements of the separator stages involved, much attention has been given to the possibility to minimise hydrogen solution losses which can be achieved by recycling part of the cold separator liquid phase to the cold separator zone either via the cold flash zone or, preferably via the warm flash zone. It should be noted, however, that the recycling of a hydrogen-enriched wash oil still bears the necessity of a wash oil pump of considerable size which inevitable costs in hardware, energy requirements and large separator vessels to accomodate the large streams to be processed.

It has now surprisingly been found that a four separator system can be operated without the use of a wash oil (recycle) stream, and consequently at much reduced hydrogen solution losses when the hot separator is operated under specific conditions. Operating the separators in accordance with the present invention also allows a better heat integration scheme which usually allows a reduction in the unit's heat exchanger surface area requirements.

The present invention thus relates to a process for separating a mixed-phase hydrocarbonaceous effluent originating from the treatment of a hydrocarbonaceous feedstock in the presence of hydrogen at elevated temperature and pressure in a multiple separator system, which effluent contains hydrogen, normally liquid hydrocarbonaceous components and normally gaseous hydrocarbonaceous components by (i) separating in a first separation zone the effluent into a first liquid phase (L1) and a first vapour phase (V1),
(ii) cooling the first vapour phase obtained to a temperature in the range between 25° and 85° C. and separating the cooled vapour phase in a second separation zone whilst substantially maintaining the pressure of the first separation zone into a second liquid phase (L2) and a second hydrogenrich vapour phase (V2),
(iii) separating the first liquid phase in a third separation zone whilst substantially maintaining the temperature of the first separation zone and at a pressure below 60 bar into a third liquid phase (L3) and a third vapour phase (V3), and
(iv) separating the second liquid phase in a fourth separation zone whilst substantially maintaining the temperature of the second separation zone and at a pressure below 60 bar into a fourth liquid phase (L4) which is at least partially recovered as product and a fourth vapour phase (V4), and wherein the first separator zone is operated at a temperature between 200° and 350° C. and in such a way that between 25 and 75% w of the effluent is obtained in the first vapour phase (V1).

The present invention relates in particular to a process for separating a mixed-phase hydrocarbonaceous effluent wherein the first separation zone is operated in such a way that between 40 and 60% w of the effluent is obtained in the first vapour phase (V1).

Without wishing to be bound to any particular theory it would appear that the introduction of a rather large amount of normally liquid effluent in the first vapour phase (V1) has a very beneficial effect on the amount of hydrogen recoverable in the second vapour phase (V2) without the need of a wash oil, let alone a substantial amount of wash oil to be produced in the fourth separator.

The effluent to be subjected to the mixed-phase separating process according to the present invention can be obtained by any hydroconversion process giving at least some products with boiling ranges in the middle distillate range and/or above and which are separable by using the process according to the present invention. Suitable effluents comprise those obtained by the hydrocatalytic conversion of hydrocarbonaceous feedstocks such as crude oils, atmospheric distillates, vacuum distillates, deasphalted oils and oils originating from tar sands and shale oils.

Generally, hydroconversion and hydrocracking are suitable processes to produce the effluents to be treated in accordance with the present invention. If desired, (hydro)demetallisation and/or (hydro)desulphurisation may be carried out prior to the proper hydroconversion or hydrocracking process. Also hydrofinishing process stream effluents can be worked up conveniently using the process according to the present invention.

The hydroconversion and hydrocracking processes can be carried out under the usual conditions for such processes which include the use of a catalyst and the presence of hydrogen at elevated temperature and pressure. Depending on the type of products desired the process conditions may be adjusted. Normal operating conditions comprise temperatures in the range between 250° and 450° C. and pressures in the range between 35 and 200 bar, preferably temperatures in the range between 300° and 425° C. and pressures between 45 and 175 bar.

The hydroconversion and/or hydrocracking processes can be carried out by using suitable catalysts which normally comprise one or more metal compounds of Group V, VI or VIII of the Periodic Table of the Elements on a suitable carrier. Examples of suitable metals include cobalt, nickel, molybdenum and tungsten. In particular combinations of metals comprising a Group VI and a Group VIII metal can be used advantageously.

The metal compound-containing catalysts are normally supplied in oxidic form and are then subjected to a pre-sulphiding treatment which can be carried out ex situ but preferably in situ, in particular under conditions which resemble actual practice. The metal components can be present on inorganic amorphous carriers such as silica, alumina or silica-alumina and can be introduced on the refractory oxides by a variety of techniques including impregnation, soaking and co-mulling. Catalysts to be used in hydrocracking may be of the amorphous type but preferably of zeolitic nature. In particular zeolite Y and modern modifications of zeolite Y have proven to be very good materials to serve in hydrocracking processes. Again, the metal components can be emplaced on the zeolites by any technique known in the art, including impregnation and ion-exchange. It is also possible and in fact preferred for certain hydrocracking processes to use in addition to the zeolite an amorphous silica-alumina component in the catalyst in addition to a binder which is normally present in such catalysts.

The amounts of catalytically active materials may vary between wide limits. Suitably of from 0.1 to as much as 40% w of a metal component can be used in the catalysts for hydroconversion and hydrocracking. Suitably, a flashed distillate, i.e. a distillate obtained by atmospheric distillation of a crude oil and having a boiling range between 380° and 600° C. can be used as feedstock for a hydrocracking process followed by the separation technique in accordance with the present invention. It is possible, of course, to use also distillates obtained via a residue conversion process as part or all of the feedstock for the hydrocracker. In particular mixtures of flashed and synthetic distillate can be subjected suitably to a hydrocracking operation and the effluent subjected to the separation technique in accordance with the present invention.

Typically a hydrocracker and/or hydroconversion unit effluent will become available at elevated temperature and pressure depending on the process conditions applied in the appropriate reactor. Normally, the effluent to be separated will have a temperature between 250° and 450° C. and a pressure between 35 and 200 bar.

The effluent from the reactor(s) is sent to the first separation zone (indicated as S1, the Hot High Pressure Separator) which is operated substantially at the pressure at which the hydroconversion or hydrocracking process was carried out and at a temperature which allows 25 to 75% w of the reactor effluent to become available in the first vapour phase (V1). Suitably, the boiling range of the normally liquid hydrocarbonaceous components does not exceed 400° C. Normally liquid hydrocarbonaceous components are components which are liquid when calculated at 25° C. at atmospheric pressure.

Preferably, the first vapour phase (V1) contains normally liquid hydrocarbons having a boiling range not exceeding 375° C. Preferably, the first separation zone is operated at a temperature between 250° and 315° C. and at the pressure exerted in the reactor delivering the effluent. It will be clear that a slight deviation from the process pressure applied can be tolerated but it is preferred to carry out the first separation at substantially the same pressure. Normally, such pressures will range between 35 and 200 bar, preferably between 125 and 175 bar.

The first vapour phase (1) obtained from the first separation zone is sent to the second separation zone (S2) normally after a heat exchange to cool it down to allow a further separation. The second separation zone (the Cold High Pressure Separator) is normally operated at substantially the same pressure as the first separator, or as close to it as is feasible, and at a temperature in the range between 25° and 85° C. By operating the first and the second separator in the modes as indicated a second vapour phase (V2) is obtained containing a high amount of hydrogen which obviates the need for a wash oil (normally supplied by recycling part of the liquid phase from the fourth separation zone to the second separation zone).

The hydrogen separated is of sufficient purity to be recycled, if desired after a repressurising treatment, to the hydroconversion unit or hydrocracker delivering the effluent. It may be combined with make-up or fresh hydrogen to be used in the hydroprocessing reactor to supply the amount of hydrogen needed in accordance with the operating conditions for the hydroprocessing being carried out, including supply of hydrogen in the hydrogen-consuming process.

The first liquid phase obtained (L1) and containing effluent having a normal boiling point range exceeding 400° C. is sent to the third separation zone (S3) (the Hot Low Pressure Separator) which is operated at substantially the same temperature as the first separation zone, or as close to it as is feasible without adding energy to achieve this situation, and at a pressure in the range between 10 and 50 bar. It should be noted that part of the first liquid phase (L1) may be recycled to the hydroprocessing reactor, if desired together with part or all of the recycle-hydrogen and/or any fresh or make-up hydrogen as the case may be. By operating the third separation zone in this mode a third vapour phase (V3) is obtained which can be further processed or which is preferably sent at least in part to the stream entering the fourth separation zone to be described hereinafter. Also a third liquid phase (L3) is obtained which can also be subjected to further processing or which may recovered at least in part as product and which may be collected from the system, if desired together with part or all of the fourth liquid phase to be described hereinafter.

The second liquid phase obtained when operating the second separation zone is sent, optionally with part or all of the third vapour phase obtained when operating the third separation zone, to the fourth separation zone (S4) (the Cold Low Pressure Separator) which is operated at substantially the same temperature as the second separation zone and at a pressure substantially the same as operated in the third separation zone. The fourth separation zone is preferably operated at a temperature in the range between 25° and 85° C. and at a pressure in the range between 10 and 50 bar. By operating the fourth separation zone in the manner as indicated hereinabove a fourth vapour phase (V4) is obtained which is basically a low pressure mixture of oil and gas which can be used for various refinery duties and a fourth liquid phase (L4) which is at least in part and optionally together with part or all of the third liquid phase (L3) recovered as product. It can be used as such or may be subjected to further treatment such as distillation and hydrofinishing.

It will be clear that the sequence and the conditions prevailing in the process according to the present invention allow for the recovery of in principle the total fourth liquid phase which does not have to be used to increase the amount of hydrogen obtainable in the second vapour phase at all. The present invention is now illustrated by means of the following Example.

EXAMPLE

A hydrocracking process is carried out by subjecting a flashed distillate feedstock (boiling range 380°–600° C.) to a treatment with hydrogen in the presence of a standard hydrocracking catalyst of amorphous nature (based on Ni/W as catalytically active metals) under conditions which allow complete conversion to 395° C. minus products.

The effluent from the single stage hydrocracker is sent to the Hot High Pressure Separator (S1) which is operated at 154 bar and at a temperature of 300° C. It may be necessary to subject the effluent from the hydrocracker to a heat-exchange procedure in order to arrive at the desired temperature in S1.

A first vapour phase (V1) is obtained from S1 and sent to a heat-exchange system to allow the temperature to be reduced to 45° C. whilst maintaining the pressure substantially at the pressure at which S1 is operated. The thus cooled first vapour phase which contains 59% w of the effluent submitted to S1 is sent to the Cold High Pressure Separator (S2) which is operated at about 45° C. and 150 bar. From S2 the second vapour phase, rich in hydrogen, is withdrawn having a purity of well above 85% vol and which is sent, optionally after slight repressurising, to the hydrocracker, if desired together with fresh or make-up hydrogen.

The first liquid phase obtained (L1) can be recycled in part to the hydrocracker but is preferably sent to the Hot Low Pressure Separator (S3) operated at substantially the same temperature as is S1 and at a pressure of about 25 bar. The third vapour phase obtained from S3 is sent to the fourth separation zone as described hereinafter. The third liquid phase (L3) is conveniently withdrawn as product.

The second liquid phase (L2) withdrawn from S2 is sent to the Cold Low Pressure Separator (S4) in combination with the third liquid phase (L3). S4 is operated at substantially the same temperature as is S2 and at substantially the same pressure as is S3. The fourth liquid phase (L4) is recovered as product, optionally together with the third liquid phase (L3) depending on the further use of said phase. No fourth liquid phase is recycled as wash oil to the stream entering S2. The fourth vapour phase obtained (V4) contains low temperature, low pressure oil and gas and can be used in further processing/upgrading or as part of the refinery fuel pool.

By operating the multiple separator system for the separation of the mixed-phase hydrocarbonaceous effluent in accordance with the process of the present invention substantial savings in hydrogen losses are realised. When the process is repeated at conditions which require the presence of a recycle stream to be withdrawn from S4 (which normally on a weight basis is about 50% of the total stream entering S2) the hydrogen losses are increased by about 40%. Since also expensive equipment is needed under such conditions (wash oil pump to restore the pressure from 45 to no less than 50 bar) the advantages of the process according to the present invention will be clear.

I claim:

1. A process for separating a mixed-phase hydrocarbonaceous effluent originating from the conversion of a hydrocarbonaceous feedstock in the presence of hydrogen at elevated temperature and pressure in a multiple separator system, which effluent contains hydrogen, normally liquid hydrocarbonaceous components and normally gaseous hydrocarbonaceous components, said process comprising the steps of:

(a) separating said effluent in a first separation zone into a first liquid phase (L1) and a first vapor phase (V1), said first separation zone being operated at a temperature in the range of 200° to 350° C. and in such a manner that between 25 and 75% by weight of said effluent is recovered as said first vapor phase (V1);

(b) cooling said first vapor phase (V1) to a temperature in the range of 25° to 85° C. and separating said cooled first vapor phase in a second separation zone into a second liquid phase (L2) and a second, hydrogen-rich vapor phase (V2), said second separation zone being operated at substantially the same pressure as said first separation zone;

(c) separating said first liquid phase (L1) in a third separation zone into a third liquid phase (L3) and a third vapor phase (V3), said third separation zone being operated at a pressure below 60 bar while substantially maintaining the temperature of said first separation zone; and (d) separating said second liquid phase (L2) in a fourth separation zone into a fourth liquid phase (L4) and a fourth vapor phase (V4), said fourth liquid phase being at least partly recovered as a product, and wherein said fourth separation zone is operated at a pressure below 60 bar while substantially maintaining said zone at the temperature of said second separation zone.

2. The process of claim 1 wherein said first separation zone is operated in such a manner that between 40 to 60 weight % of said effluent is recovered as said first vapor phase (V1).

3. The process of claim 1 wherein said first vapor phase contains normally liquid hydrocarbonaceous components having a normal boiling point range not exceeding 400° C.

4. The process of claim 1 wherein said first vapor phase contains normally liquid hydrocarbonaceous components having a normal boiling point range not exceeding 375° C.

5. The process of claim 1 wherein said first separation zone is operated at a temperature in the range of 250° to 315° C. and at a pressure in the range of 35 to 200 bar.

6. The process of claim 1 wherein said first separation zone is operated at a pressure in the range of 125 to 175 bar.

7. The process of claim 1 wherein at least a portion of said third and fourth liquid phases are recovered as product.

8. The process of claim 1 wherein at least a portion of said third vapor phase (V3) is combined with said second liquid phase (L2) prior to being passed to said fourth separation zone.

9. The process of claim 1 wherein said third separation zone is operated at a pressure in the range of 10 to 50 bar.

10. The process of claim 1 wherein said fourth separation zone is operated at a temperature in the range of 25° to 85° C. and at a pressure in the range of 10 to 50 bar.

11. The process of claim 1 further comprising recovering at least a portion of said hydrogen present in said second vapor phase (V2).

12. The process of claim 11 further comprising recycling at least a portion of said recovered hydrogen to said conversion zone for said hydrocarbonaceous feedstock.

13. The process of claim 12 wherein said hydrogen is purified prior to being recycled.

14. The process of claim 12 wherein said hydrogen is recycled under increased pressure.

15. The process of claim 1 wherein said hydrocarbonaceous effluent originates from a hydroconversion process.

16. The process of claim 15 wherein said hydrocarbonaceous effluent originates from a hydrocracking process.

17. The process of claim 16 wherein said hydrocarbonaceous effluent originates from a single stage hydrocracking process.

18. The process of claim 15 wherein said hydroconversion process is carried out in the presence of a catalyst comprising one or more supported metal compounds of Groups V, VI or VIII of the Periodic Table.

19. The process of claim 18 wherein said catalyst comprises zeolite Y and a binder.

20. The process of claim 19 wherein said catalyst comprises zeolite Y, an amorphous cracking component and a binder.

* * * * *